US005164555A

United States Patent [19]

Brenton

[11] Patent Number: 5,164,555

[45] Date of Patent: Nov. 17, 1992

[54] ROTATING PADDLE BIN LEVEL INDICATOR

[75] Inventor: Ronald G. Brenton, Marysville, Mich.

[73] Assignee: Bindicator Company, Port Huron, Mich.

[21] Appl. No.: 758,753

[22] Filed: Sep. 12, 1991

[51] Int. Cl.[5] ..... H01H 35/00

[52] U.S. Cl. ..... 200/61.21

[58] Field of Search ..... 200/61.2, 61.21; 219/209, 1

[56] References Cited

U.S. PATENT DOCUMENTS

| | | | |
|---|---|---|---|
| 2,116,075 | 5/1938 | Lenhart | 200/61.21 |
| 2,632.083 | 3/1953 | Shaffer | 219/209 |
| 2,851,553 | 9/1958 | Grostick | 200/61.21 |
| 2,909,766 | 10/1959 | Bozich | 340/615 |
| 3,210,493 | 10/1965 | Lau | 200/61.2 |
| 3,210,495 | 10/1965 | Lau | 200/61.21 |
| 3,412,877 | 11/1968 | Lee et al. | 414/296 |
| 3,436,059 | 4/1969 | Donaldson | 366/331 |
| 3,510,861 | 5/1970 | McIver et al. | 307/116 |
| 3,542,982 | 11/1970 | Gruber | 200/61.21 |
| 3,560,752 | 2/1971 | Lee et al. | 250/214 R |
| 3,665,359 | 5/1972 | Alms | 200/61.21 X |
| 3,721,971 | 3/1973 | Gruber | 307/116 |
| 3,818,159 | 6/1974 | Evans et al. | 200/61.21 |
| 3,941,956 | 3/1976 | Delin et al. | 200/61.2 |
| 4,095,064 | 6/1978 | Fleckenstein | 200/61.21 |
| 4,147,906 | 4/1979 | Levine | 200/61.2 |
| 4,211,966 | 7/1980 | Sweet | 318/482 |
| 4,318,624 | 3/1982 | Jett | 366/349 |
| 4,392.032 | 7/1983 | Roach, II | 200/61.21 |
| 4,506,804 | 3/1985 | Oka | 222/64 |
| 4,551.663 | 11/1985 | Gruber | 318/482 |
| 4,695,685 | 9/1987 | Fleckenstein et al. | 200/61.21 |

OTHER PUBLICATIONS

Catalog entitled Monitor Automatic Level Indicators, copyright 1979, published by Monitor Manufacturing, Elburn, IL 60119, a division of Ludlow Industries, Inc.

Catalog entitled Bin-Master Rotaroy Automatic Level Indicator; Dec. 1979.

Catalog entitled Bin-Master Bin Level Indicators 45 and 55 Series (no date).

*Primary Examiner*—J. R. Scott

*Attorney, Agent, or Firm*—Kisselle Barnes Raisch Choate Whittemore & Hulbert

[57] ABSTRACT

Apparatus for indicating the level of flowable material in a storage bin that includes a motor mounted within a protective enclosure and coupled by a shaft and clutch arrangement to a paddle disposed within the bin to engage material therewithin. When the material reaches the level of the paddle, drag on the paddle causes the motor to rotate within the enclosure against the force of an adjustable spring to activate switches disposed within the enclosure for indicating material level. The switches also remove power from the motor and apply power to an electrical resistance heater to warm the enclosure and help prevent condensation at low external ambient temperature. The paddle is constructed to enhance drag when used in conjunction with low-density materials.

20 Claims, 3 Drawing Sheets

ROTATING PADDLE BIN LEVEL INDICATOR

BACKGROUND OF THE INVENTION

The present invention is directed to bin level indicators, and more particularly to an improved apparatus of the rotating-paddle type for indicating the level of flowable material in a storage tank or bin.

Bin level indicators of the above-noted type typically comprise a motor carried for limited rotation within a protective enclosure and connected to a rotatable paddle that is adapted to engage flowable material within a storage bin when the material rises to the bin level at which the rotating paddle is disposed. Material drag on the paddle causes the motor drive torque to rotate the motor rather than the paddle, which rotation is sensed by one or more switches carried within the enclosure. The switches may be connected to deactivate a conveyor feeding material to the bin, to remove power from the indicator motor and/or to perform other control functions related to material level. Examples of bin level indicators of the described type are shown in the Grostick U.S. Pat. No. 2,851,553, Gruber U.S. Pat. No. 3,542,982, Fleckenstein U.S. Pat. No. 4,095,064, Levine U.S. Pat. No. 4,147,906, Roach U.S. Pat. 4,392,032 and Fleckenstein et al U.S. Pat. No. 4,695,685.

A problem is encountered in application of conventional apparatus to lightweight (low density) materials such as fly ash and plastic powder or pellets. Specifically, light material weight is sometimes insufficient to retard rotation of the paddle permitting the paddle to "plow" a path through the material and continue rotation even though covered by material. Another and related problem lies in factory setting of spring force on the motor, which must be overcome by drag on the paddle to permit rotation of the motor against the spring when drag is placed on the paddle, and to return the motor to the normal position when the paddle is again free to rotate. Typically, spring force is determined during apparatus design as a function of a typical material weight and drag, and is not adjustable in the field as a function of density of material in connection with which the indicator will be used.

Another problem typically encountered with conventional bin level indicators of the subject type involves inability of an observer or operator to determine the condition of the indicator, and consequently level of material within the bin with respect to the indicator, through observation of the indicator itself. An indicator may be positioned at the top of a tall storage bin, for example, and connected to a remote display panel for indicating material level at a central location. However, an observer at the bin itself cannot determine the status of the bin level indicator. A further problem is encountered in connection with bin level indicators of the subject type in which power is removed from the indicator motor when rotation of the paddle is retarded. Insufficient power is dissipated within the indicator housing to generate heat sufficient to prevent condensation during cold weather, which can damage switch contacts and other components of the indicator.

SUMMARY OF THE INVENTION

It is a general object of the present invention to provide an improved rotating paddle bin level indicator that is more economical to fabricate and assemble than are typical prior art indicators of similar type. In furtherance of the object stated immediately above, it is another object of the present invention to provide an improved rotating paddle bin level indicator that has a reduced number of component parts, and in which component parts may be either purchased as standard off-the-shelf elements or maybe fabricated at minimum expense. Yet another object of the present invention is to provide a bin level indicator of the subject type that is of compact construction, making the indicator particularly well suited for applications in which only a limited amount of space is available.

Yet another object of the present invention is to provide an improved paddle for a rotating paddle bin level indicator that is adapted to be inserted into a material bin through a relatively small indicator mounting gland, and is constructed for increasing drag on the paddle when used in conjunction with low-density and lightweight materials. A further object of the present invention is to provide a bin level indicator of the subject type in which power is removed from the motor when rotation of the paddle is retarded, and in which power is applied to an electrical resistance heating element to maintain elevated temperature within the housing to help prevent condensation when the paddle is stalled. Another object of the present invention is to provide a mechanism through which indicator status may be observed externally of the indicator.

The invention, together with additional objects, features and advantages thereof, will be best understood from the following description, the appended claims and the accompanying drawings in which:

DESCRIPTION OF THE PREFERRED EMBODIMENT

Figure 1:
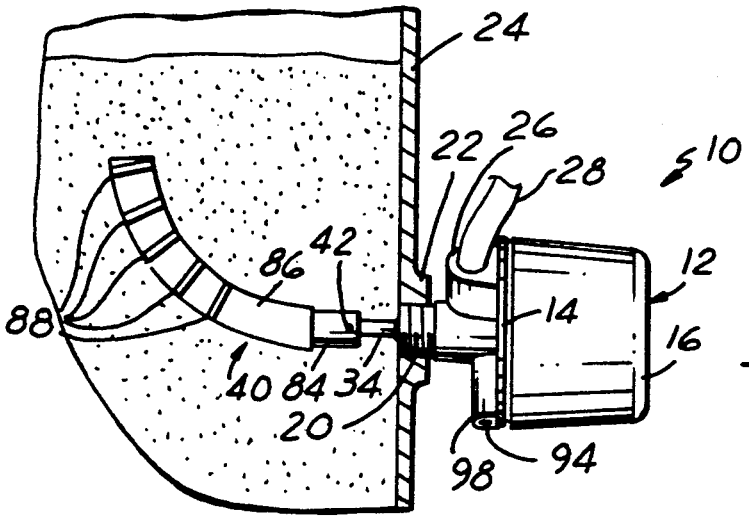
FIG. 1 is a fragmentary elevational view, particularly in section, showing a presently preferred embodiment of a bin level indicator in accordance with the present invention.

Referring to the drawings, a presently preferred embodiment 10 of a bin level indicator in accordance with the present invention includes a generally cylindrical protective housing or enclosure 12 comprising a flat base 14 and a cup-shaped top or cover 16 externally threaded over the periphery of base 14. A gasket 18 is captured between the open edge of cover 16 and the periphery of base 14 for sealing the hollow interior of enclosure 12. A hollow externally threaded nipple 20 extends outwardly from base 14, and is adapted to be threadably received in a corresponding internally threaded gland 22 (FIG. 1) carried by the wall of a material storage tank or bin 24. An internally threaded laterally opening aperture 26 on base 14 is adapted to receive a strain-relief grommet or the like through which a multiple-conductor electrical cable 28 is fed for connection to a source of utility power and other apparatus (not shown) disposed externally of enclosure 12.

Figures 4, 4A:
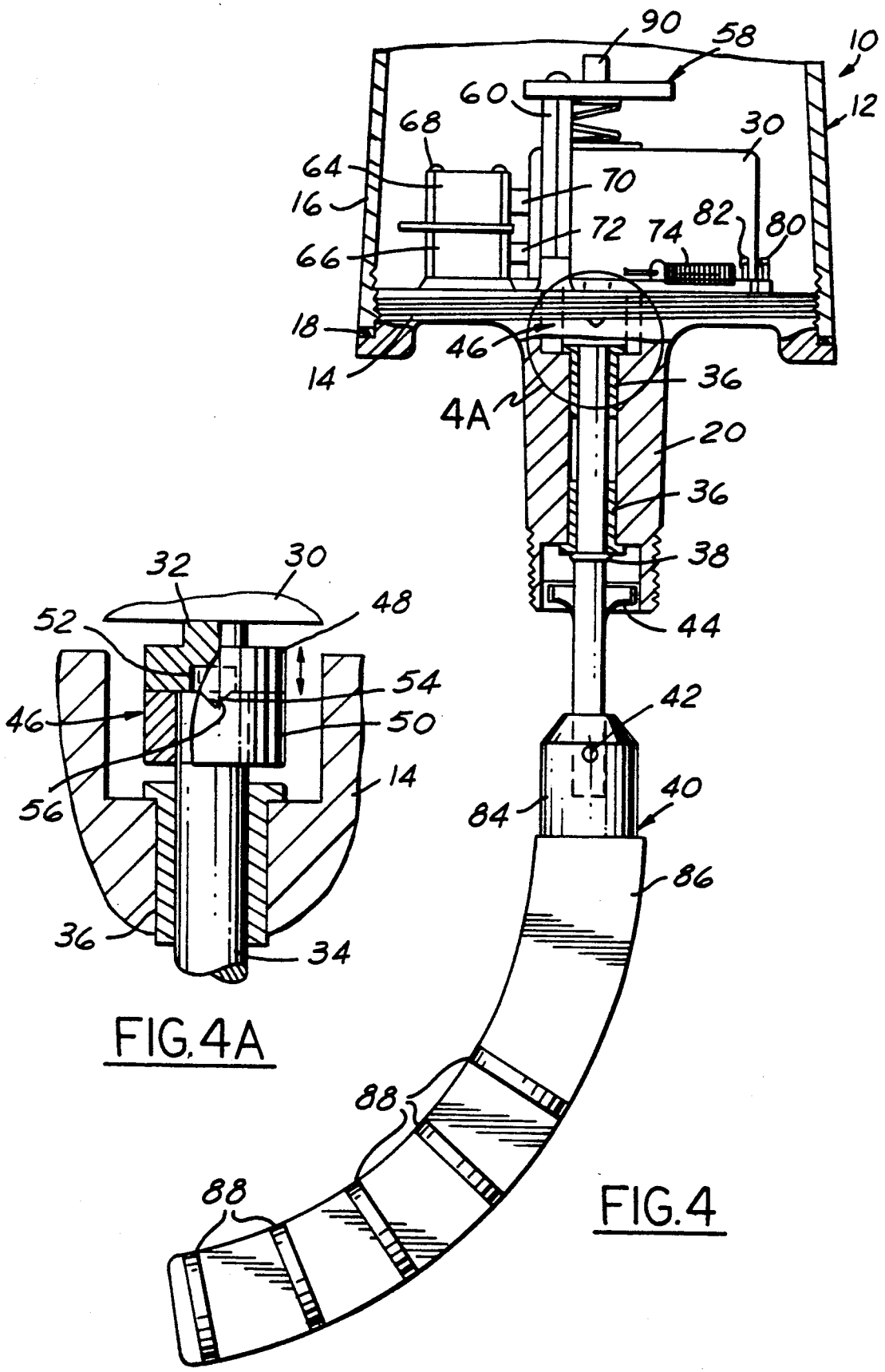
FIG. 4 is a fragmentary partially sectioned elevational view of the indicator.
FIG. 4A is an enlarged view of the portion of the indicator illustrated in FIG. 4 encircled by the circle 4A.

Within enclosure 12, indicator 10 includes an electric motor 30 from which a rotatable shaft 32 projects eccentrically of the side of the motor. A drive shaft 34 extends through sleeve bearings 36 captured within nipple 20, being held against axial motion by a retaining ring 38 on the outside of the bottom sleeve bearing. Drive shaft 34 projects beyond the outer end of nipple 20, and is rotatably connected to a paddle 40 by being received within a corresponding aperture in the paddle and retained therein by a lateral pin 42. A lip seal 44 surrounds shaft 34 at the outer end of nipple 20 for sealing the housing interior from dust and atmosphere within storage bin 24 (FIG. 1). Drive shaft 34 is coaxial with motor shaft 32 and is coupled thereto by a clutch mechanism 46 best illustrated in FIG. 4A. Motor shaft 32 terminates in a clutch plate 48 that is perpendicular to the axis of shaft 32. Likewise, drive shaft 34 terminates in a clutch plate 50 that is perpendicular to the axis of drive shaft 34 and opposed to clutch plate 48. A cylindrical projection 52 on shaft 34 is rotatably received within a corresponding recess in clutch plate 48 for maintaining coaxial alignment of shafts 32,34. A triangular rib 54 extends diametrically across clutch plate 48 (being interrupted by the recess that receives projection 52). A complementary triangular groove or channel 56 extends diametrically across clutch plate 50 (being interrupted by axial projection 52).

Figure 3:
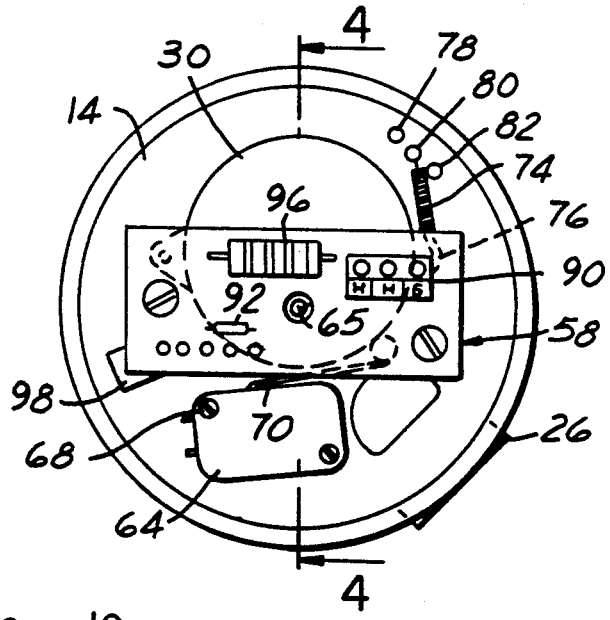
FIG. 3 is a top plan view of the indicator housing with the cover removed.

Within housing 12, a circuitboard assembly 58 is mounted on base 14 over motor 30 by a pair of standoffs 60. A coil spring 62 is captured in compression between circuitboard assembly 58 and the upper or paddle-remote side of motor 30 coaxially with motor shaft 31 A boss 64 on motor 30 maintains spring 62 in lateral position. A pin 65 on the housing of motor 30 extends upwardly therefrom through spring 62 coaxially with shaft 32, and is rotatably received within an opening on circuitboard assembly 58 (as best seen in FIG. 3) for maintaining lateral position of the motor. Spring 62 thus urges motor 30 shaft 32 and clutch plate 48 into opposed abutting engagement with shaft 34 and clutch plate 50. A pair of switches 64,66 are mounted by screws 68 on base 14 radially adjacent to the housing of motor 30. Switches 64,68 have arms 70,72 that extend into engagement with the housing of motor 30. The housing of motor 30 is eccentric to the axis of motor shaft 32 so that rotation of housing 30 within enclosure 12 activates switches 64,66 in the manner described in the above-noted U.S. patents.

A coil spring 74 (FIGS. 3 and 4) extends in tension tangentially of the motor housing between an apertured lip or tab 76 on the housing of motor 30, and one of three studs or pins 78,80,82 affixed to base 14. Spring 74 biases motor 30 to the position illustrated in the drawings when paddle 40 is free to rotate within bin 24, stalling of paddle rotation causing counter-rotation of the motor and housing against the force of spring 74 so as to activate switches 64,66. The force biasing the motor against counter-rotation when rotation of the paddle is stalled is thus selectively adjustable in the field by removing cover 16 and selectively positioning spring 74 among pins 78,80 and 82. Low biasing force is applied by the spring when the spring is coupled to pin 82, which is closest to tab 76. Medium biasing force is applied when the spring is coupled to pin 80 as shown in the drawings, and maximum biasing force is applied when spring 74 is coupled to pin 78 that is furthest from motor housing tab 76. Thus, the biasing force on the motor housing resisting counter-rotation of the housing within the indicator enclosure is selectively adjustable in the field as a function of weight and/or density in connection with which the indicator is to be used.

Paddle 40 in the preferred embodiment of the invention takes the form of a homogeneously integral one-piece body of molded plastic or cast aluminum construction, for example. The body is of arcuate construction, extending over an arc of approximately 90°, from a cylindrical bland 84 to which drive shaft 34 is pinned through a flat section 86 that is coplanar with the axis of shaft 34. A plurality of vanes or ribs 88 are spaced from each other lengthwise of flat section 86, being integral with section 86 and disposed in respective planes perpendicular to the lengthwise dimension of paddle section 86. Ribs 88 are of semi-circular contour, and function in operation to increase drag of rotation of paddle 40 through surrounding material, and thereby to improve operation of the indicator in lightweight and low-density materials. Ribs 88 also help prevent cavitation, which may result from "plowing" of the paddle through the material, by helping to agitate the material as the paddle moves therethrough.

Figure 5:
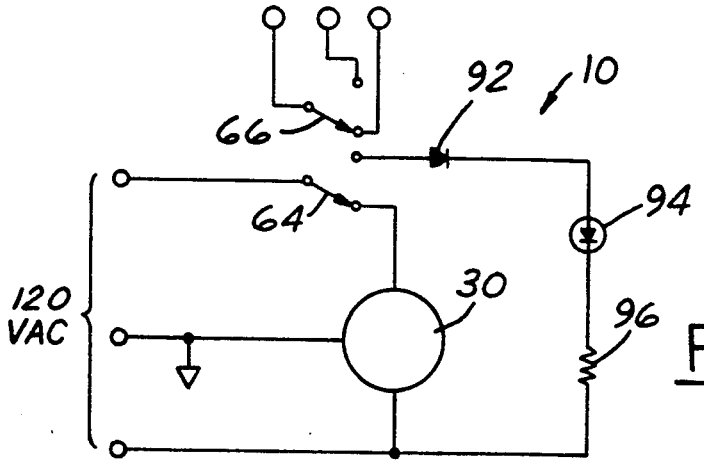
FIG. 5 is an electrical schematic diagram of the indicator illustrated in FIGS. 1–4A.
Figure 2:
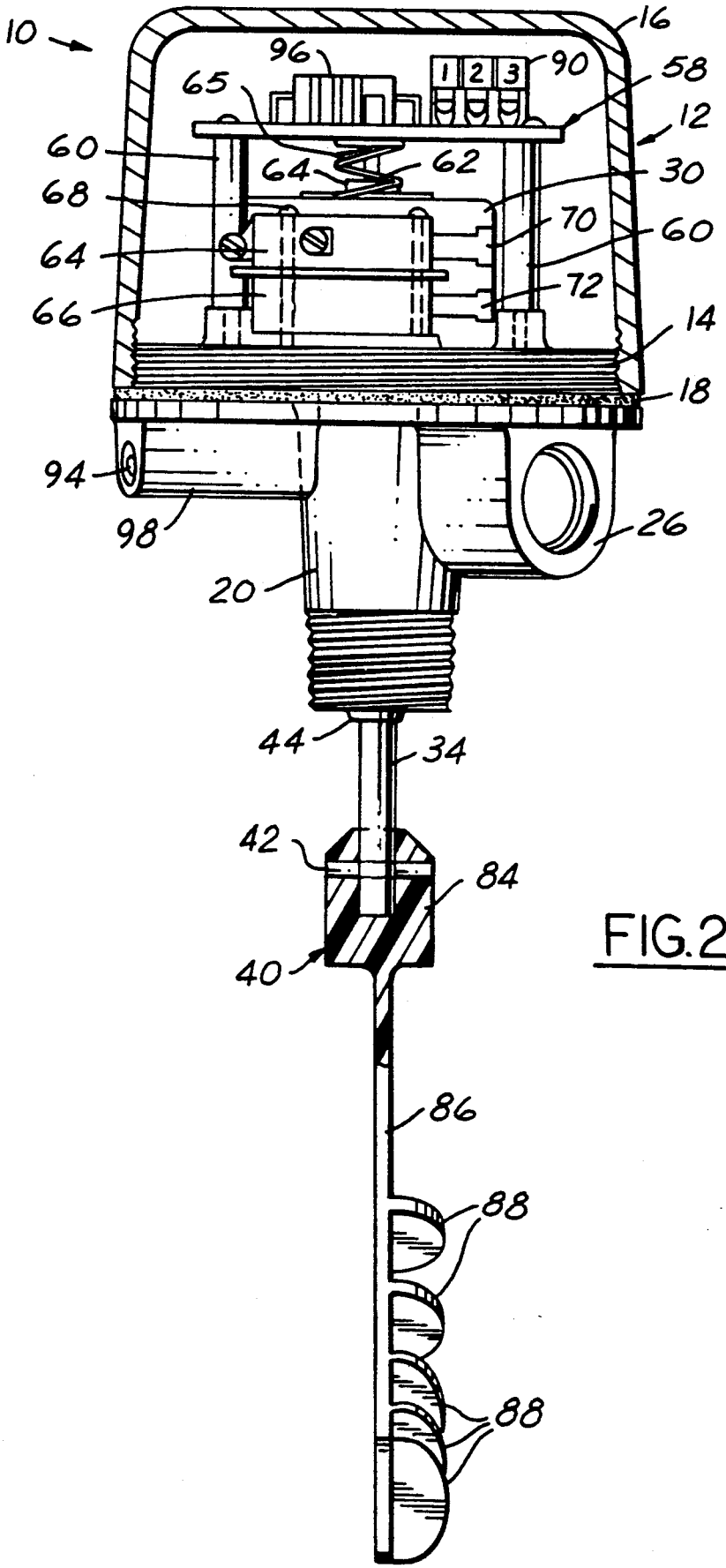
FIG. 2 is a partially sectioned side elevational view of the indicator illustrated in FIG. 1.

Electronics of indicator 10, including circuitry on board assembly 58, are illustrated in FIG. 5. Utility power, such as 120 VAC, is fed to motor 30 by cable 28 (FIG. 1), a terminal block 90 on circuitboard assembly 58 (FIGS. 2–4), and the normally closed contacts of switch 64. The normally open contact of switch 64 is connected through a rectifying diode 92 (FIGS. 3 and 5) and through an LED 94 to a resistor 96, and thence returned to utility power. LED 94 is positioned within an apertured boss 98 beneath base 14. Resistor 96 is carried by circuitboard assembly 58 and is of relatively high wattage—e.g., one watt. Switch 66 has common, normally open and normally closed contacts for connection through cable 28 to appropriate external display and/or control mechanisms.

In operation, with material spaced from paddle 40, power is applied to motor 30 through switch 64, and motor 30 rotates paddle 40 within bin 24. When the level of material within bin 24 reaches the level of paddle 40, as shown in FIG. 1, the material retards rotation of the paddle. Torque developed by the motor rotates the motor housing in the opposite direction against the force of spring 74, activating switches 64,66 from the normally closed positions illustrated in FIG. 5 to the normally open positions. In the latter position, switch 64 removes utility power from motor 30, and applies utility power to the series combination of diode 92, LED 94 and resistor 96. Half-wave utility power passes diode 92 and illuminates LED 94, which is observable from externally of the housing by an operator or the like. The current through resistor 96 generates heat to help prevent condensation within housing 12 at low external ambient temperatures while power is removed from motor 30. When the level of material thereafter declines below the level of contact with paddle 40 and paddle 40 is again free to rotate, spring 74 returns motors 30 and switches 64,66 to their normal positions illustrated in the drawings, power is reapplied to motor 30 and paddle 40 is again rotated.

Clutch 46 prevents damage to motor 30 and/or paddle 40 in the event that the paddle is suddenly stuck by a stream of material. In the event of such an occurrence, rib 54 is cammed upwardly (in the orientation of FIG. 4A), against the force of spring 62 on motor 30, by the sloping sides of channel 56. Motor shaft 32 continues rotation until rib 54 again registers with channel 56, at which time the rib is snapped back into the channel by spring 62, and the clutch is re-engaged.

I claim:

1. Apparatus for indicating level of material in a storage bin comprising a hollow enclosure including means for mounting said enclosure to a storage bin, motor means mounted for movement within said enclosure, a paddle, means operatively coupling said paddle to said motor means, said paddle being located within the bin when said enclosure is mounted thereto and rotation of said paddle being retarded when material stored in the bin is at a level stallably to engage said paddle, means mounted within said enclosure for detecting movement of said motor means within said enclosure when rotation of said paddle is retarded by material in the bin, and means coupled to said movement-detecting means for indicating level of material in the bin; characterized in that said means operatively coupling said paddle to said motor means comprises a clutch including a first clutch plate coupled to said motor means and a second clutch plate coupled to said paddle and disposed within said enclosure in opposition to said first clutch plate, a rib on one of said clutch plates and a channel on the other of said clutch plates of complementary geometry to said rib and opposed to said rib, a fixed support within said enclosure, and first spring means within said enclosure between said support and said motor means resiliently urging said motor means toward said paddle so as to urge said rib into nesting engagement with said channel.

2. The apparatus set forth in claim 1 wherein said rib and said channel are of complementary triangular cross sectional geometry.

3. The apparatus set forth in claim 1 wherein said indicating means comprises an aperture in said enclosure and optical indicating means disposed in said aperture such that indication of material level in the bin is observable from externally of said enclosure.

4. The apparatus set forth in claim 1 wherein said paddle comprises an arcuate body coupled at one end to said operatively coupling means and extending axially and radially therefrom, and at least one rib upstanding from said body to increase drag on rotation of said paddle upon engagement with material.

5. The apparatus set forth in claim 4 wherein said at least one rib comprises a plurality of ribs spaced from each other lengthwise of said body.

6. The apparatus set forth in claim 5 wherein said arcuate body is of flat planar construction, and wherein said plurality of ribs are of homogeneously integral construction with said body.

7. The apparatus set forth in claim 1 further comprising second spring means extending between said motor means and said support urging said motor means to a limit of angular travel within said enclosure, characterized in that said support includes means for selectively adjusting force of said second spring means on said motor means.

8. The apparatus set forth in claim 7 wherein said force-adjusting means comprises a plurality of spring anchor means disposed at differing fixed positions on said support for selective coupling to said second spring means.

9. The apparatus set forth in claim 1 wherein said motor means includes an electric motor, and wherein said apparatus further comprises means coupled to said movement-detecting means for removing electrical power from said motor, an electrical resistance heater and means responsive to said, movement-detecting means for applying electrical power to said heater when power is removed from said motor to prevent condensation within said enclosure.

10. Apparatus for indicating level of material in a storage bin comprising a hollow enclosure including means for mounting said enclosure to a storage bin, motor means mounted for movement within said enclosure, a paddle, means operatively coupling said paddle to said motor means, said paddle being located within the bin when said enclosure is mounted thereto and rotation of said paddle being retarded when material stored in the bin is at a level stallably to engage said paddle, means mounted within said enclosure for detecting movement of said motor within said enclosure when rotation of said paddle is retarded by material in the bin, and means coupled to said movement-detecting means for indicating level of material in the bin; characterized in that said paddle comprises an arcuate body coupled at one end to said operatively-coupling means and extending axially and radially therefrom, and a plurality of ribs spaced from each other lengthwise of said body and upstanding from said body in respective planes perpendicular to the lengthwise dimension of said body for increasing drag on rotation of said paddle upon engagement with material.

11. The apparatus set forth in claim 10 wherein said arcuate body is of flat planar construction, and wherein said plurality of ribs are of homogeneously integral construction with said body.

12. The apparatus set forth in claim 10 wherein said indicating means comprises an aperture in said enclosure and optical indicating means disposed in said aperture such that indication of material level in the bin is observable from externally of said enclosure.

13. The apparatus set forth in claim 10 further comprising a fixed support within said enclosure and spring means extending between said motor means and said support urging said motor means to a limit of angular travel within said enclosure, characterized in that said support includes means for selectively adjusting force of said spring means on said motor means.

14. The apparatus set forth in claim 13 wherein said force-adjusting means comprises a plurality of spring anchor means disposed at differing fixed positions on said support for selective coupling to said spring means.

15. The apparatus set forth in claim 10 wherein said motor means includes an electric motor, and wherein said apparatus further comprises means coupled to said movement-detecting means for removing electrical power from said motor, an electrical resistance heater and means responsive to said movement-detecting means for applying electrical power to said heater when power is removed from said motor to prevent condensation within said enclosure.

16. Apparatus for indicating level of material in a storage bin comprising a hollow enclosure including means for mounting said enclosure to a storage bin, motor means mounted for movement within said enclosure, a paddle, means operatively coupling said paddle to said motor means, said paddle being located within the bin when said enclosure is mounted thereto and rotation of said paddle being retarded when material stored in the bin is at a level stallably to engage said paddle, means mounted within said enclosure for detecting movement of said motor within said enclosure when rotation of said paddle is retarded by material in the bin, means coupled to said movement-detecting means for indicating level of material in the bin, a fixed support within said enclosure and spring means extending between said motor means and said support urging said motor means to a limit of angular travel within said enclosure, characterized in that said support includes means for selectively adjusting force of said spring means on said motor means comprising a plurality of spring anchor means disposed at differing fixed positions on said support means, said spring means being selectively anchored to one of said anchor means for varying force applied by said spring means to said motor means as a function of the anchor means to which said spring means is anchored.

17. The apparatus set forth in claim 16 wherein said indicating means comprises an aperture in said enclosure and optical indicating means disposed in said aperture such that indication of material level in the bin is observable from externally of said enclosure.

18. The apparatus set forth in claim 16 wherein said motor means includes an electric motor, and wherein said apparatus further comprises means coupled to said movement-detecting means for removing electrical power from said motor, an electrical resistance heater and means responsive to said movement-detecting means for applying electrical power to said heater when power is removed from said motor to prevent condensation within said enclosure.

19. The apparatus set forth in claim 16 wherein said paddle comprises an arcuate body coupled at one end to said operatively-coupling means and extending axially and radially therefrom, and a plurality of ribs spaced from each other lengthwise of said body and upstanding from said body in respective planes perpendicular to the lengthwise dimension of said body for increasing drag on rotation of said paddle upon engagement with material.

20. The apparatus set forth in claim 19 wherein said arcuate body is of flat planar construction, and wherein said plurality of ribs are of homogeneously integral construction with said body.

* * * * *